United States Patent [19]

Matthews

[11] 4,260,362

[45] * Apr. 7, 1981

[54] FUEL IGNITION CONTROL ARRANGEMENT HAVING A TIMING CIRCUIT WITH FAST RESET

[75] Inventor: Russell B. Matthews, Goshen, Ind.

[73] Assignee: Johnson Controls, Inc., Milwaukee, Wis.

[ * ] Notice: The portion of the term of this patent subsequent to Sep. 25, 1996, has been disclaimed.

[21] Appl. No.: 910,682

[22] Filed: May 30, 1978

Related U.S. Application Data

[63] Continuation-in-part of Ser. No. 839,743, Oct. 5, 1977, Pat. No. 4,168,947.

[51] Int. Cl.[3] ..... F23N 5/00

[52] U.S. Cl. ..... 431/69; 431/45; 431/78

[58] Field of Search ..... 431/25, 27, 43, 67, 431/69, 78, 79, 80, 71, 45

[56] References Cited

U.S. PATENT DOCUMENTS

| | | | |
|---|---|---|---|
| 3,619,097 | 11/1971 | Clay | 431/80 |
| 3,920,376 | 11/1975 | Wyland | 431/79 |
| 3,938,737 | 2/1976 | Matthews | 431/71 |
| 3,938,937 | 2/1976 | Matthews | 431/80 |
| 3,947,220 | 3/1976 | Dietz | 431/80 |
| 4,087,229 | 5/1978 | Teichert et al. | 431/25 X |
| 4,116,613 | 9/1978 | Matthews | 431/78 |
| 4,168,947 | 9/1979 | Matthews | 431/78 |

*Primary Examiner*—Samuel Scott
*Assistant Examiner*—Lee E. Barrett
*Attorney, Agent, or Firm*—Emrich, Root, Lee, Brown & Hill

[57] ABSTRACT

An arrangement for a direct ignition type fuel ignition system includes a capacitive timing network which enables a flame relay to operate during a trial for ignition interval, energizing a fuel valve to supply fuel to a burner for ignition, and a flame sensing circuit which causes the flame relay and the fuel valve to be maintained operated only if a flame is sensed before the end of the trial for ignition interval. In the absence of a flame, a diode, back biased by the timing signal, decouples the flame sensing circuit from the timing network When a flame is established, a further diode, back biased by a control signal provided by the flame sensing circuit, decouples the timing network from the flame sensing circuit. In an embodiment wherein the charging time of a capacitor defines the trial for ignition interval, a fast reset circuit provides rapid discharge of the timing capacitor when power is removed from the timing network. In another embodiment, wherein the discharge time of a capacitor defines the trial for ignition interval, a checking relay, energized over normally closed contacts of the flame relay, operates to disconnect the capacitor from a source of charging current and complete a discharge path for the capacitor enabling the timing network to generate the timing signal. The checking relay is prevented from operating, thereby maintaining the system locked out, if the flame relay is operated at the start of an ignition cycle.

8 Claims, 5 Drawing Figures

FUEL IGNITION CONTROL ARRANGEMENT HAVING A TIMING CIRCUIT WITH FAST RESET

RELATED APPLICATION

This is a Continuation-in-Part application of co-pending application Ser. No. 839,743, now U.S. Pat. No. 4,168,947, which was filed on Oct. 5, 1977. As to common subject matter, applicant claims the benefit of the priority date of said application under 35 U.S.C. 120.

BACKGROUND OF THE INVENTION

1. Field of the Invention

The present invention relates to fuel ignition systems of the direct ignition type, and more particularly, to a control circuit for use in such systems for controlling the operation of a fuel supply valve and spark generator of the system.

2. Description of the Prior Art

In direct ignition type fuel ignition systems, a fuel supply valve is energized tentatively at the start of each heating cycle to supply fuel to a burner for ignition by sparks provided by a suitable spark generator. If the fuel fails to be ignited within a predetermined time, commonly referred to as a trial for ignition period, the valve is deenergized, and the system is locked out.

Direct ignition systems include a valve control circuit which includes a timing device, or more commonly an electronic timing circuit, which determines the duration of the trial for ignition interval, and effects the deenergiation of the fuel supply valve whenever the fuel fails to be ignited before the end of the trial for ignition. One such system is disclosed in my U.S. Pat. No. 3,938,937 which was issued on Feb. 17, 1976. The patented system employs a capacitive timing circuit which permits a controlled switching device to be enabled to effect energization of a fuel supply valve during the trial for ignition interval which is defined by the charging time of a capacitor of the timing circuit.

It the fuel is not ignited before the ignition timing capacitor is fully charged, the timing circuit disables the controlled switching device, causing the fuel supply valve to be deenergized. On the other hand, if the fuel is ignited during the trial for ignition period, flame current is supplied to the controlled switching device, overriding the timing circuit to permit the fuel supply valve to remain operated for the balance of the heating cycle.

The control circuit includes a discharge network for discharging the timing capacitor at the end of each heating cycle. The discharge network provides a shunt discharge path of relatively high resistance which prevents the capacitor from discharging during the heating cycle and permits the capacitor to be fully discharged when the system is deactivated at the end of the heating cycle. However, for momentary loss of power following a successful ignition followed by a flameout, the power interruption may not last long enough to permit the timing capacitor to be fully discharged, so that the system becomes locked out when power is restored. Thus, it would be desirable to have a fuel ignition control arrangement including a capacitive timing network in which rapid discharge of the ignition timing capacitor is provided whenever the system is deactivated, but which allows the timing capacitor to provide its timeout function when the system is activated.

Another direct ignition system employing a capacitive timing circuit is disclosed in the U.S. Pat. No. 3,619,097 to Clay et al which was issued on Nov. 9, 1971. In this system, the timing circuit includes a pair of timing capacitors which are charged substantially instantaneously upon application of power to the system. The timing capacitors slowly discharge over a discharge network, defining a trial for ignition interval by the time it takes one of the capacitors to discharge. The timing capacitors form a voltage divider network which establishes an operating potential for a controlled switching device, embodied as field effect transistor, which when enabled, effects the energization of a fuel supply valve. When the capacitors are discharged, the field effect transistor is disabled, causing the valve to be deenergized. If a flame is established before the end of the trial for ignition interval, a flame sensing means, which is directly connected to the timing circuit, supplies flame current to the timing capacitors to maintain the capacitors charged. Thus, in this system, where timing capacitors are charged rapidly and then discharged to define the trial for ignition interval, the discharge network is used in determining the trial for ignition interval. Also, since the flame sensing means is directly connected to the timing circuit, under certain conditions, there may be undesirable interaction between the flame sensing means and the timing circuit in the absence of a flame.

A further consideration is that in direct ignition systems, the flame sensing means responds to the relatively large main burner flame to effect its control operation to maintain the system operating when a flame is established.

In many instances, this requires the use of flame sensing probes of different lengths in similar control circuits, and careful positioning of the probe relative to the burner in order to prevent too large a flame from effecting reliable operation of the control circuit or causing the system to become locked out.

SUMMARY OF THE INVENTION

The present invention provides a control arrangement for controlling the operation of a fuel supply valve and spark generator in a direct ignition type fuel ignition system. At the start of an ignition cycle, a capacitive timing network generates a timing signal defining a trial for ignition interval. The timing signal is applied to a control circuit to enable a switching device to energize a flame relay for operating the fuel valve to supply fuel to a burner for ignition by sparks provided by the spark generator. If a flame is established before the end of the trial for ignition interval, a flame sensing circuit generates a control signal, or flame current, which maintains the switching device enabled after the trial for ignition interval. If a flame is not established before the end of the trial for ignition interval, the switching device is disabled, deenergizing the flame relay to cause the valve to cut off fuel supply to the burner.

In accordance with the invention, the flame sensing circuit is decoupled from the control circuit and the timing network in the absence of a flame. The decoupling is provided by a diode which is reverse biased when the timing signal is provided and in the absence of the control signal, and which is forward biased whenever the control signal is provided. This prevents interaction between components of the timing network which define the trial for ignition interval, and components of the flame sensing circuit which provide the control signal.

In one embodiment, the charging time of a capacitor defines the duration of the trial for ignition interval, and a fast reset circuit effects rapid discharge of the timing capacitor whenever power is removed from the timing network. This prevents the system from becoming locked out on momentary power interruptions.

The control arrangement may include a checking relay for determining the integrity of the control circuit and the flame relay before an ignition cycle is initiated. The checking relay is enabled over first circuit path provided by contacts of the flame relay which are closed whenever it is disabled. The fuel supply valve is energized over a second circuit path provided by contacts of the flame relay and the checking relay when the two relays are operated. The checking relay also controls the enabling of the timing network and a spark generator, maintaining them disabled when the checking relay is disabled. If for any reason the first circuit path is interrupted at the start of an operating cycle, the checking relay is prevented from operating so that the energizing path for the fuel supply valve is interrupted, and the control circuit and spark generator are maintained disabled. This prevents operation of the fuel supply valve, and the system is maintained locked out.

In this embodiment, the initiation of trial for ignition is conditioned upon operation of the checking relay at the start of an operating cycle. The timing capacitor is normally maintained discharged by a discharge network of a reset circuit. When the checking relay operates, it connects the timing capacitor to a source of power, enabling the capacitor to charge to define the trial for ignition interval. The reset circuit is also energized when the checking relay operates, and decouples the timing capacitor from the discharge network.

When power is removed from the reset circuit at the end of a heat run, the timing capacitor is coupled to the discharge network, and the discharge network provides rapid discharge of the timing capacitor. Thus, in the event of a momentary interruption of power to the control arrangement during an operating cycle, the timing capacitor, which determines the duration of the trial for ignition interval, is rapidly discharged, and prepared to initiate a full trial for ignition interval upon restoration of power. This prevents lock out of the system for a momentary loss of power.

In accordance with a feature of the invention, the reset circuit includes circuit means for maintaining the timing capacitor charged in the event of a fault of the reset circuit by which the timing capacitor is coupled to the discharge network when power is applied to the reset circuit.

In another embodiment, capacitive discharge timing, defines the duration of the trial for ignition interval. The checking relay normally connects the timing capacitor to a source of charging current so that the capacitor is maintained charged in the absence of a call for heat. When the checking relay operates in response to a call for heat, the capacitor is disconnected from the current source and is connected to the control circuit to effect operation of the flame relay for a trial for ignition interval defined by the discharge time of the capacitor. The flame sensing circuit maintains the control circuit enabled when a flame is sensed. When a flame is provided, the timing circuit is decoupled from the control circuit and the flame sensing circuit by a further diode which is forward biased by the timing signal in the absence of the control signal, and which is reverse biased when the control signal is provided.

According to a further feature of the invention, the flame sensing circuit includes a circuit which regulates the amount of flame current supplied to the control circuit. This enables the amount of flame current supplied to the control circuit to be maintained at a level necessary for reliable operation of the control circuit. Also, the flame current limiting function obviates the need for use of flame sensing probes of different lengths for different installations of the same system, or the need for careful positioning of the flame probe to obtain the desired level of flame current.

In one embodiment, the spark generator is energized by the actuating circuit to provide ignition sparks during the trial for ignition intervals and continues to provide sparks when a flame is established, as long as the actuating circuit remains enabled. In another embodiment, the spark generator is initially enabled by the actuating circuit to provide sparks during the trial for ignition interval, and is disabled by the flame sensing circuit when a flame is provided.

DESCRIPTION OF PREFERRED EMBODIMENTS

General Description

Figure 1:
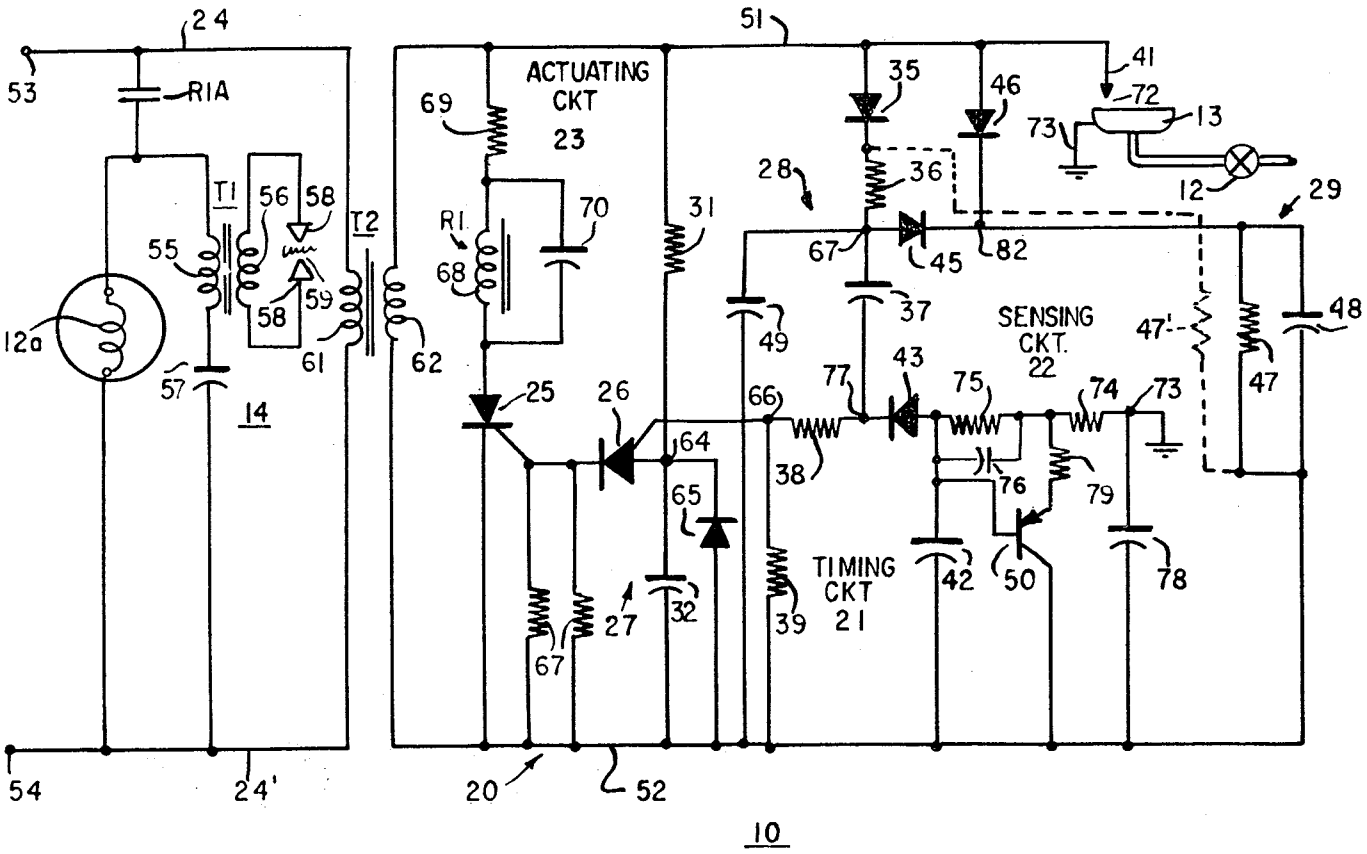
FIG. 1 is a schematic circuit diagram of a fuel ignition control system employing a control arrangement provided in accordance with the present invention.

Referring to FIG. 1, the fuel ignition control system 10 provided by the present invention is described with reference to an application in a direct ignition type heating system for controlling the operation of a fuel supply valve 12 which supplies fuel to a burner apparatus 13 for ignition by sparks provided by a spark generator 14.

A control circuit 20 energized when power is applied to input terminals 53 and 54 of the system at the start of a heating cycle, causes a relay R1 to operate and energize the fuel supply valve 12 and the spark generator 14 during a trial for ignition interval defined by a timing circuit 21. Timing circuit 21 includes a timing network 28 having a capacitor 37 which is normally maintained discharged by a discharge network 29 and which charges during the trial for ignition interval enabling a programmable unijunction transistor (PUT) 26 to conduct and effect energization of relay R1 by enabling a silicon controlled rectifier (SCR) 25 of an actuating circuit 23. Discharge network 29 provides rapid discharge of the capacitor wheneven the control circuit is deactivated. A flame sensing circuit 22, which is decoupled from the timing circuit 21 in the absence of a flame by a diode 43, controls the timing circuit 21 to maintain the relay operated when a flame is sensed before the end of the trial for ignition interval.

When energized, the relay R1 operates to close its contacts R1A to effect the energization of an operate solenoid 12*a* of the fuel supply valve 12, and to energize the spark generator 14. Accordingly, the valve 12 is operated during the trial for ignition interval to supply fuel to the burner apparatus 13 for sparks provided by the spark generator 14.

If the fuel is ignited before the end of the trial for ignition interval, defined by the charging time of capacitor 37, the flame sensing circuit 22 responds to the presence of the flame to generate a flame signal which is extended to the gate of the PUT device 26 through resistors 74 and 75 and diode 43, enabling the timing circuit 21 to maintain the relay operated to maintain the valve 12 energized. The diode 43 decouples the flame sensing circuit 22 from the timing circuit 21 in the absence of a flame to prevent interaction between these circuits. If the fuel fails to be ignited before the end of the trial for ignition interval, that is when capacitor 37 becomes fully charged, the timing circuit disables causes the relay R1 to deenergize the valve solenoid 12*a* and the spark generator 14.

Considering the control circuit 20 in more detail, relay R1 of the actuator circuit 23 is energized in response to the operation of the SCR device 25, which in turn is enabled by pulses provided by the timing circuit 21.

The timing circuit 21 includes the PUT device 26, which is operable under the control of an anode control network 27 and the timing or gate control network 28 to enable the SCR device 25. The anode control network 27 which determines the potential at the anode of the PUT device 26, includes a resistor 31 and a capacitor 32. The gate control network 28, which determines the potential at the gate of the PUT device 26, includes capacitor 37 and resistors 36, 38 and 39.

As will be described in more detail hereafter, in this embodiment, AC power is applied via conductors 51 and 52 to the control circuit 20 at the start of each heating cycle, causing capacitors 32 and 37 to charge, establishing control potentials at the anode and gate electrodes of the PUT device 26, which serve as control inputs of the device 26. The PUT device 26 is enabled whenever the anode potential exceeds the gate potential by 0.6 volts. When the PUT device 26 conducts, capacitor 32 discharges over the PUT device 26, enabling the SCR device 25 to operate the relay R1. The capacitor 32 is permitted to be charged and to discharge cyclically during the trial for ignition interval, the duration of which is determined by the charging time of capacitor 37. As long as capacitor 37 is charging, the enabling of the PUT device 26 is delayed in each cycle of the AC signal long enough to allow capacitor 32 to store sufficient charge to enable the SCR device 25. When capacitor 37 is charged fully, the PUT device 26 conducts at an earlier time in each cycle, and before capacitor 32 stores sufficient conducting change to enable the SCR device 25 to maintain relay R1 energized. This causes shutoff to the flow of fuel to the burner apparatus 13 and terminates further spark generation.

The flame sensing circuit 22 includes a sensing electrode 41 located in the proximity of the burner apparatus 13 which permits current flow through the flame where it is rectified to ground and supplied through resistors 74 and 75 and diode 43 to voltage dividing resistors 38 and 39 at point 66. The flame current is also supplied to a capacitor 42, charging capacitor. Under flame out conditions, or for a fuel interruption, the capacitor 42 permits the PUT device 26 to conduct for a period of time, less than the trial for ignition interval, providing a burner re-ignition interval to prevent nuisance lockouts.

The flame sensing circuit 22 further includes a current regulator circuit, including a transistor 50, that regulates the amount of flame current that is supplied to the gate of the PUT device 26 to a value less than that which would permit the gate potential to exceed the maximum anode voltage attainable during a given cycle of the AC signal.

In accordance with the invention, the timing circuit 21 includes a fast discharge network 29, having an initializing circuit including resistor 47 and a capacitor 48, which permits the timing capacitor 37 to be reset to an initial state, such as zero charge, each time power is removed from conductors 51 and 52 of the control circuit 20. The network 29 also includes a coupling device embodied as a diode 45, which normally disconnects the timing capacitor 37 from the initializing network when power is applied to the control circuit 20, and which is enabled when power is removed from the control circuit 20 to connect the capacitor 37 to the initializing circuit for discharging the capacitor. The discharge network 29 provides a discharge path for the capacitor 37 whenever the diode 45 is conducting. The diode 45 is maintained back-biassed by a charge on capacitor 48, which is charged when power is applied to the control circuit 20. When the power is removed from the control circuit, capacitor 48 discharges through resistor 47, removing the back-bias from the diode 45, permitting the diode to conduct and thereby allowing the capacitor 37 to discharge over the resistors 47, 38 and 39.

A capacitor 49 causes the control circuit 20 to lock out the system 10 in the event the control capacitor 48 is unable to maintain its charge, as due to an open circuit failure of the capacitor. For such condition, the diode 45 loses its back bias, permitting charge to leak off the capacitor 37 when conductor 51 is negative with respect to conductor 52, preventing the capacitor 37 from terminating the trial for ignition interval. In such case, capacitor 49 supplies a charge to capacitor 37 to maintain the capacitor 37 charged and the circuit 10 in lockout state.

Briefly, in operation, when power is applied to the system 10 at the start of a heating cycle, the control circuit 20 is energized by AC power causing capacitors 32 and 37 to charge, enabling the PUT device 26. When the PUT device 26 conducts, capacitor 32 discharges over the PUT device 26, enabling the SCR device 25 to energize the relay R1. The relay R1 operates to close contacts R1A thereby connecting the valve solenoid to the AC power lines for energization. The spark generator 14 is also energized.

Capacitor 32 continues to charge and to be discharged over the PUT device 26 during each cycle to the AC signal as long as capacitor 37 is charging, which is in the order of ten seconds in the present embodiment. If a flame is not established at the burner 13 before the end of the trail for ignition interval, that is before capacitor 37 becomes fully charged, then the PUT device 26 thereafter conducts before capacitor 32 stores sufficient energy to effect enabling of the SCR device 25, causing the deenergization of the relay R1 to shut off the supply of fuel to the burner 13 and to terminate spark generation.

However, if the fuel supplied to the burner is ignited before the end of the trial for ignition interval, then the rectified flame current supplied to the gate of the PUT device 26 delays the enabling of the device 26 in each cycle of the AC signal until the capacitor 32 stores sufficient energy to enable the SCR device 25, maintaining relay R1 energized so that the valve 12 is maintained in fuel supplying condition, until the end of the heating cycle.

When the system 10 is deactivated at the end of the heating cycle, the valve 12 and the spark generator 14 are deenergized. Also, power is removed from the control circuit 20, allowing capacitor 48 to discharge over resistors 47, removing the reverse bias from the diode 45. Accordingly, capacitor 37 is permitted to discharge, over the resistors 47, 39, 38 to be reset to zero charge in preparation for the next heating cycle.

Detailed Description

Considering the fuel ignition system 10 in more detail, the system has input terminals 53 and 54 connectable to a 24 VAC source. Terminal 53 is connected to a conductor 24 and terminal 54 is connected to a conductor 24'.

The valve operate solenoid 12*a* is connected in series with normally open contacts R1A or relay R1 between the concudtors 24 and 24' to be energized whenever contacts R1A are closed, causing the valve 12 to open to supply fuel to the burner apparatus 13.

The spark generator 14 comprises a step up transformer T1 having a primary winding 55 which is connected in series with a capacitor 57 and contacts R1A between conductors 24 and 24', and a secondary winding 56 to which is connected a pair of spark electrodes 58, which are located in the proximity of the burner apparatus 13 and disposed in a spaced relationship, defining a spark gap 59. Accordingly, whenever contacts R1A are closed, AC current flowing through the primary winding 55 causes a high voltage to be applied to the electrodes 58, producing a spark in the gap 59. The spark generator 14 continuously provides sparks whenever the system 10 is activated and relay R1 is operated.

Referring to the control circuit 20, power at 120 VAC is supplied to the control circuit by way of a step up transformer T2 which has a primary winding 61 connected to conductors 24 and 24', and a secondary winding 62 connected to conductors 51 and 52. The conductors 51 and 52 are energized whenever the system 10 is activated.

Considering the timing circuit 21, resistor 31 and capacitor 32 of the anode control network 27 are connected in series between conductors 51 and 52 providing a charging path for the capacitor 32. The junction of resistor 31 and capacitor 32 at point 64 is connected to the anode of the PUT device 26. A diode 65 is connected in parallel with the capacitor 32 between conductor 52 and point 64, providing a bypass around capacitor 32 during negative half cycles of the AC signal.

The gate control network 28 includes a diode 35, resistor 36, capacitor 37, and resistors 38 and 39 which are connected in series between conductors 51 and 52, providing a charging path for capacitor 37 during positive half cycles of the AC signal, that is, when conductor 51 is positive with respect to conductor 52. The junction of the resistors 38 and 39 at point 66 is connected to the gate of the PUT device 26. Thus, when AC power is applied to the conductors 51 and 52, capacitor 32 is charged over resistor 31, establishing a potential at the anode of the PUT device during each positive half cycle of the AC signal. Also, capacitor 37 charges over a path including resistors 36, 38 and 39, during positive half cycles of the AC signal. The charging current flowing from conductor 51 through diode 35, resistor 36, the capacitor 37 and resistors 38 and 39 establishes a potential at point 66 which is connected to the gate of the PUT device 26. When the potential at the anode of the PUT device exceeds the potential at the gate of the device by 0.6 volts, the device 26 is enabled, permitting capacitor 32 to discharge over the anode to cathode circuit thereof.

The cathode of the PUT device 26 is connected to the gate of the SCR device 25, and over redundant resistors 67 to conductor 52. The SCR device 25, which controls the energization of the relay R1, has its anode connected to one side of the operate winding 68 of the relay R1, the other side of which is connected to conductor 51 via resistor 69. The cathode of the SCR device 25 is connected to conductor 52 so that when the SCR device 25 is enabled, the operate winding 68 of the relay R1 is effectively connected between the conductors 51 and 52 for energization.

The PUT device 26 is pulsed into conduction providing an enabling pulse for the SCR device 25 during each cycle of the AC signal during the trial for ignition interval determined by the sum of resistances 36, 38 and 39 and the value of the capacitor 37. During the time that the SCR device 25 is non-conducting in response to the current reversal at the start of the negative half cycles of the AC signal, the relay R1 is maintained energized by a capacitor 70 which is connected in parallel with the operate winding 68 of the relay R1.

Diode 45 and resistor 47 of the discharge network 29 are connected in series between the positive side of capacitor 37 at point 67 and conductor 52. The diode 45, which decouples the timing capacitor 37 from the discharge network, is operated as a switch to normally interrupt the discharge path for the capacitor 37 when power is applied to the conductors 51 and 52. The diode 45 is maintained reverse biased by capacitor 48 which is connected in a unidirectional charging path with a diode 46 between conductors 51 and 52, with the junction of the diode 46 and the capacitor 48 at point 82 being connected to the anode of the diode 45. Diode 46 maintains the capacitor 48 charged to the peak of the voltage on conductor 51 during positive half cycles of the AC signal. The charge stored by capacitor 48 maintains diode 45 back biased during positive and negative half cycles of the AC signal.

Capacitor 49, which causes the control circuit 20 to lock out the system in the event of an open circuit failure for capacitor 48, is connected between the positive side of the capacitor 37 at point 67 and conductor 52 to supply charging current to capacitor 37 during negative half cycles of the AC signal.

In certain applications, fast discharge of capacitor 37 may not be required, and a bleeder resistor 47', shown by dotted lines in FIG. 1, may be used to discharge capacitor 37. By way of example, resistor 47' may be in the order of 10 megohms, providing a relatively slow discharge time, in the order of ten seconds, for capacitor 37. When bleeder resistor 47′ is used, diodes 45 and 46, resistor 47 and capacitor 48 are not used.

With reference to the flame sensing circuit 22, sensor electrode 41 is connected to conductor 51 and is positioned adjacent to the burner apparatus 13 in a spaced relationship therewith, defining a gap 72 therebetween which is bridged by the flame whenever the fuel is ignited. The burner apparatus 13 is connected to system ground at point 73, permitting rectified flame current flow from ground point 73 over resistors 74 and 75 and a capacitor 42 to conductor 52, charging the capacitor 42. The DC current also flows through resistors 74, 75, decoupling diode 43 and resistors 38 and 39 to the gate of the PUT device 26, permitting the PUT device 26 to continue to be enabled after capacitor 37 has been fully charged. Diode 43 decouples the timing circuit 21 from the flame sensing circuit 22 in the absence of flame current. A by-pass capacitor 78 is connected between ground at point 73 and conductor 52 to bypass spark RF interference signals. A further capacitor 76 is connected in parallel with resistor 75.

Transistor 50 of the flame current regulating circuit adjusts the flame current flowing into resistor 38 and thereby the voltage at the gate of the PUT device 26. Transistor 50 has its base connected to the anode of diode 43, and its emitter connected through a current limiting resistor 79 to the junction of resistors 74 and 75. The collector of transistor 50 is connected to conductor 52. Transistor 50 monitors current flow through resistor 75 and diode 43, and when the voltage drop across the resistor 75 reaches a predetermined level, transistor 50 conducts, bypassing some of the current to conductor 52. This maintains the voltage applied to the gate of PUT device 26 at the correct value for reliable operation. This current limiting function prevents the size of the burner flame from affecting circuit operation, and obviates the need for critical positioning of sensor probe 41 in order to prevent too large a flame from causing the circuit to go to a lock out state.

Operation

When 24 VAC is applied to input terminals 53 and 54 in response to a request for heat, power at 120 VAC is supplied to the control circuit 20 over transformer T2. When conductor 51 is positive with respect to conductor 52, current flows through resistor 31 and capacitor 32, thereby charging the capacitor 32. Further, current flow through diode 46 and capacitor 48 to conductor 52 charges capacitor 48 to establish a back bias for diode 45.

Current also flows through diode 35, timing resistor 36, timing capacitor 37 and voltage dividing resistors 38 and 39 to conductor 52, establishing a potential at the gate of the PUT device. The values of resistors 31, 36, 38 and 39 and timing capacitors 32 and 37 are selected so that the energy stored on capacitor 32 during each cycle of the AC signal is sufficient to enable the SCR device 25 when the anode potential of the PUT device 26 exceeds the gate potential of the device by 0.6 volts which happens every cycle. During negative half cycles of the AC signal, current flows from conductor 52 through diode 65 and resistor 31 to conductor 51, bypassing capacitor 32, to prevent the capacitor 32 from charging. Also, diodes 35 and 45 are reversed biased, preventing the capacitor 37 from discharging.

When the PUT device 26 is rendered conductive, capacitor 32 discharges over the anode to cathode circuit thereof providing a pulse for enabling the SCR device 25 which then conducts, energizing the relay R1. The relay R1 then operates to close contacts R1A energizing solenoid 12*a* causing the valve 12 to open supplying fuel to the burner apparatus. The spark generator 14 is also energized, and generates sparks for igniting fuel emanating from the burner apparatus 13.

Thereafter, capacitor 37 continues to charge during positive half cycles of the AC signal for approximately ten seconds by which time capacitor 37 is fully charged. The charging current for capacitor 37 produces a voltage across resistors 38 and 39 which maintains the gate of PUT device 26 at a potential to cause SCR 25 to fire in response to the discharge of capacitor 32 for the duration of the trial for ignition interval. Capacitor 37 always charges completely by the end of the time for ignition period, and its charging current drops to zero whether a flame becomes established or not.

If the fuel fails to be ignited before the end to the trial for ignition interval, the capacitor 37 is fully charged, and its charging current drops to zero. Although PUT device 26 continues to conduct cyclically as capacitor 32 is charged in each half cycle, the PUT device 26 is fired at such a low anode voltage level that the discharge pulse of capacitor 32 is not high enough to fire the SCR device 25. Thus, relay R1 is deenergized, opening contacts R1A to deenergize the fuel valve solenoid 12*a* allowing the valve to close shutting off fuel supply to the burner. Also, spark generator 14 is deactivated, terminating spark generation and the system is locked out until power is removed from conductors 53 and 54.

When the high voltage spark ignites the fuel, then during positive half cycles, current flows from conductor 51 over electrode 41, through the flame where it is rectified to ground at point 73, thence through resistors 74 and 75 and capacitor 42 to conductor 52, charging the capacitor. Flame current also flows from point 73 through resistors 74 and 75 diode 43 and resistors 38 and 39 to conductor 52, establishing a gate potential for the PUT device 26, which delays enabling of the device 26 until capacitor 32 has charged sufficiently to enable the SCR device 25 upon discharge of the capacitor 32. This enables the relay R1 to be maintained energized after the end of the trial for ignition interval so that the valve is maintained in fuel supplying condition and the spark generator 14 continues to provide sparks.

For large flame conditions at the burner, the large value of flame current flow through resistor 75 enables transistor 50 to conduct and bypass some of the flame current to conductor 52 over resistor 79 and the emitter collector circuit of the transistor 50. This keeps the voltage applied to the gate of the PUT device 26 at the correct value for reliable operation.

When the heating demand has been met, and the system 10 is deactivated, the fuel supply valve 12 and the spark generator 14 is deenergized, and power is removed from the control circuit 20. Accordingly, the relay R1 is deenergized, and the charge on capacitor 48 dissipates through resistor 47, removing the back bias from the diode 45, which then becomes forward biased, and completes the discharge circuit for the capacitor 37 over resistors 47, 39 and 38, permitting the capacitor 37 to discharge. Capacitor 37 is thus reset to zero charge in preparation for the next heating cycle. It is pointed out that the capacitor 37 is also reset to zero charge in the manner set forth above in the event of a momentary loss of power during a heating cycle. Accordingly, when power is restored, a new trial for ignition is initiated and the system is not locked out.

If for any reason diode 45 loses its back bias, as for example, for an open circuit condition for capacitor 48, the charge on capacitor 37 will leak off through the resistor 48 during negative half cycles of the AC signal. For such condition, the charge which leaks off capacitor 37 is supplied via capacitor 49 to the capacitor 37, to maintain the capacitor 37 charged, and if the circuit is in a lock out state, such condition is maintained. When capacitor 48 is open circuit, the trial for ignition period is decreased from ten seconds to 1.5 seconds.

Under flameout or fuel interruption conditions, which result in the temporary interruption of the flow of flame current, the charge on the capacitor 42 permits the PUT device 26 to be enabled for a period of time, less than the trial for ignition interval. This permits the fuel valve 12 and the spark generator 14 to be maintained energized in order that the burner be reignited. If the fuel fails to be reignited within the trial for ignition interval defined by the discharge time of capacitor 42 under fuel interruption or flame out conditions, then the control circuit 20 causes the system 10 to go to a lock out state.

Second Embodiment

Figure 2:
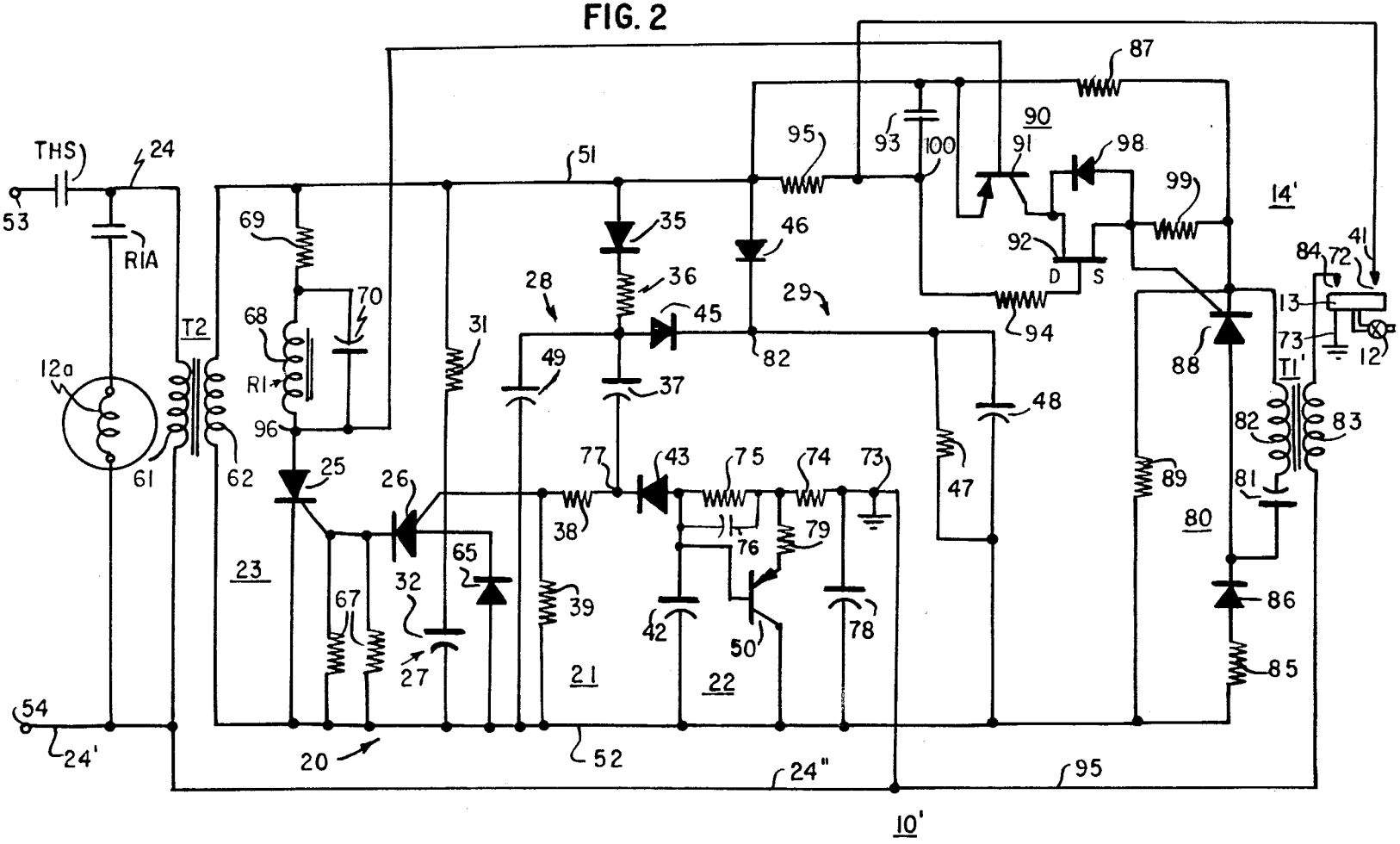
FIG. 2 is a schematic circuit diagram of a fuel ignition control system including the control arrangement provided by the present invention, and which employs a spark generator which is disabled in response to flame current whenever a flame is provided.

Referring to FIG. 2, there is shown a schematic circuit diagram of a second embodiment for a fuel ignition control system 10' provided by the present invention. The system 10' employs the fuel supply valve 12 and the control circuit 20 of the system 10 shown in FIG. 1, and thus, like elements have been given the same reference numerals. Also, normally open thermostatically controlled contacts THS are shown connected between input terminal 53 and conductor 24 so that the system 10' is activated in response to the closing of the contacts THS. Conductor 24' is referenced to system ground at point 73 by way of conductor 24'' shown connected between conductor 24' and point 73.

In addition, the system 10' includes a spark generator 14' which is controlled by the control circuit 20 to be enabled during the trial for ignition and to be disabled when a flame is established, or at the end of the trial for ignition when the fuel fails to be ignited.

The spark generator 14' is similar to the one disclosed in the U.S. Pat. No. 3,947,220, which was issued to Gerald Dietz on Mar. 30, 1976, and was assigned to the assignee of the present application. The spark generator 14', which is of the capacitor discharge type, includes a spark producing or generating circuit 80, having a capacitor 81 which is charged and then discharged over the primary winding 82 of a step up transformer T1' during alternate half cycles of the AC signal to generate a high voltage spark at an electrode 84 which is connected to the secondary winding 83 of the transformer T1'. The electrode 84 is located in the proximity of the grounded burner 13 in spaced relation therewith, permitting the spark to ignite fuel emanating from the burner.

The spark generator 14' also includes an enabling circit 90 including a normally disabled switching device, embodied as a transistor 91, and a second normally enabled switching device, embodied as a field effect transistor (FET) 92, and a bypass capacitor 93. Transistor 91 is enabled by the actuating circuit 23 to enable the spark producing circuit 80 during the trial for ignition interval. The flame sensing circuit 22 disables the FET device 92 when a flame is provided, thereby inhibiting the spark producing circuit 80 in a manner to be shown below.

Considering the spark generating circuit in more detail, capacitor 81 is connected in a unidirectional charging path which extends from conductor 52 over a resistor 85, a diode 86, capacitor 81, the primary winding 82 of transformer T1' and resistor 87 to conductor 51. Accordingly, capacitor 81 is charged during negative half cycles of the AC signal. A controlled switching device, embodied as a silicon controlled rectifier 88, has its anode to cathode circuit connected in parallel with the series connected capacitor 81 and winding 82. A resistor 99 is connected between the gate and the cathode of the SCR device 88 to bypass reverse gate current when the SCR device 88 is triggered into conduction. The SCR device 88, when enabled, provides a discharge path for the capacitor 81 over the primary winding 82. The discharge current induces a high level voltage pulse in the secondary winding 83 which is applied to electrode 84 which is connected to one end of the winding 83, the other end of which is connected over a conductor 95 to system ground at point 73. The electrode 84 is located in the proximity of the burner apparatus 13 which is connected to ground at point 73. As will be shown, the SCR device 88 is enabled by the enabling network 90 during positive half cycles of the AC signal whenever a flame is not impinging on the sensor electrode 41.

Referring to the enabling circuit 90, the transistor 91 has its emitter connected to conductor 51 and its base connected at point 96 to the junction of operate winding 68 of relay R1 and the anode of the SCR device 25. The collector of transistor 91 is connected to the drain electrode of the FET device 92 which has its source elelctrode connected to the gate of the SCR device 88 of the spark generating circuit 80. The gate electrode of the FET device 92 is connected over resistors 94 and 95 to conductor 51. A diode 98 is connected between the source and drain of the FET device 92 to protect the FET device 92 from spark RF interference signals. The FET device 92 is an N-channel junction type device which conducts in the absence of a negative bias at its gate electrode, and which is pinched off when the potential at its gate is negative with respect to the potential at its drain.

Accordingly, when the SCR device 25 conducts, base emitter current flows through transistor 91 and the SCR device 25 to conductor 52, causing the transistor 91 to conduct. When transistor 91 conducts, current flows through the emitter-collector circuit of the transistor, the drain-source circuit of the FET device 92, the gate cathode circuit of the SCR device 88, and over resistor 89 to conductor 52, causing the SCR device 88 to conduct. When the SCR device 88 conducts, capacitor 81 discharges over the transformer T1'. During negative half cycles, the transistor 91 is cutoff interrupting current flow to the FET device 92.

For the purpose of disabling the spark generating circuit 80 when a flame is established, resistor 94, which is connected between the flame sensing probe or electrode 41, at point 100, and the gate of the FET device 92, extends a control potential to the gate of the FET device 92 whenever a flame bridges the gap 72 between the electrode and the burner 13.

When a flame is established at the burner apparatus 13, then during positive half cycles of the AC signal supplied to conductors 51 and 52, current flows from conductor 51 through resistor 95, the sensing probe 41 and the flame where it is rectified to ground at point 73, thence through resistors 74 and 75 and resistors 38 and 39 to conductor 52. A capacitor 93, which is connected between conductor 51 and point 100 bypasses voltage spikes around the gate of the FET device 92.

The voltage at point 100 is applied via resistor 94 to the gate of the FET device 92. This voltage is negative with respect to the voltage supplied to the drain of the FET device 92, which is thus pinched off, interrupting the flow of current to the gate of the SCR device 88 of the spark generating circuit 80. This prevents discharge of the capacitor 81 thereby terminating spark generation.

Should a flame fail to be established at the end of the trail for ignition interval, so that the SCR device 25 becomes disabled, then transistor 91 is also disabled thereby inhibiting the spark generating circuit 80.

Thus, in summary, the spark generator 14' is enabled by the actuator circuit 23 at the start of a heating cycle. The spark generator 14' is disabled in response to the flame current provided by the flame sensing circuit 22 when a flame is established, or is disabled by the control circuit 20 at the end of the trial for ignition interval when capacitor 37 is fully charged and effects disabling of the actuator circuit 23.

Operation

Considering the operation of the fuel ignition system 10', it is assumed that the input terminals 53 and 54 are connected to a source of 24 VAC and that thermostat contacts THS are open. When contacts THS close, in response to a request for heat, power at 120 VAC is supplied over transformer T2 to conductors 51 and 52 for activating the control circuit 20.

The control circuit 20 operates as described above with reference to the system 10 shown in FIG. 1. That is, the voltage on conductor 51 acting through timing capacitor 37 and capacitor 32 causes the PUT device 26 to conduct, enabling the SCR device 25 effecting energization of the relay R1 during the trial for ignition interval. Relay R1 operates to close contacts R1A effecting energization of the valve 12, supplying fuel to the burner apparatus 13.

Also, when the SCR device 25 conducts, the enabling circuit 90 enables the spark generating circuit 80 to generate sparks for igniting the fuel. More specifically, during the first negative half cycle of the AC signal, after power is applied to conductors 51 and 52, capacitor 81 is charged over resistor 85, diode 86, primary winding 82 and resistor 87. During the next positive half cycle of the AC signal, when the SCR device 25 is conducting, transistor 91 is also enabled and extends current over the FET device 92 to the gate of the SCR device 88 which then conducts, providing a discharge path for capacitor 81 through the primary winding of the transformer T1', causing a spark to be generated. This operation continues until the fuel is ignited or the trial for ignition interval ends.

If ignition fails to occur before the end of the trial for ignition, the SCR device 25 is disabled as described above, causing transistor 91 to be maintained cut off. Accordingly, further enabling of the SCR device 88 is prevented, and spark generation is terminated.

If the fuel is ignited within the trial for ignition interval, the current flows from conductor 51 through the resistor 95, the probe 41 and the flame where it is rectified to ground, and thence through the flame sensing circuit 22 to conductor 52. The voltage drop across resistor 95 is applied via resistor 94 to the gate of the FET device 92 which pinches off to stop the flow of current to the gate of the SCR device 88. Accordingly, capacity 81 is prevented from discharging and spark generation is terminated.

The spark generating circuit 80 is maintained disabled until the system 10' is deactivated in response to the opening of contacts THS at which time the valve 12 and the control circuit 20 are deactivated.

If a flame out occurs, the current path between the sensing probe 41 and ground 73 becomes a virtual open circuit, terminating the flow of current therethrough. Thus, the voltage drop across resistor 95 goes to zero removing the signal from the gate of the FET device 92, which then conducts allowing current to flow to the gate to SCR device 88 reenabling the spark generating circuit 80. If the fuel fails to be reignited within the trial for ignition time, defined by the discharge time of capacitor 42, the PUT device 26 effects the disabling of the SCR device 25, disabling the spark generating circuit, and deenergizing the relay R1 to deactivate the fuel valve 12. If on the other hand, the fuel is reignited, the spark generating circuit is disabled with the resumption of flow of flame current.

Thus, in the system 10' shown in FIG. 2, the spark generator 14' is controlled by the timing circuit 21 and the flame current when a flame is provided. That is, as long as the control circuit 20 is operating in the trial for ignition interval, the spark generating circuit 80 is enabled. When the ignition attempt is successful, the flow of flame current effects disabling of the spark generating circuit 80. For an unsuccessful ignition attempt, the timing circuit 21 effects disabling of the spark generating circuit and the deenergization of the fuel supply valve 12.

Third Embodiment

Figure 3:
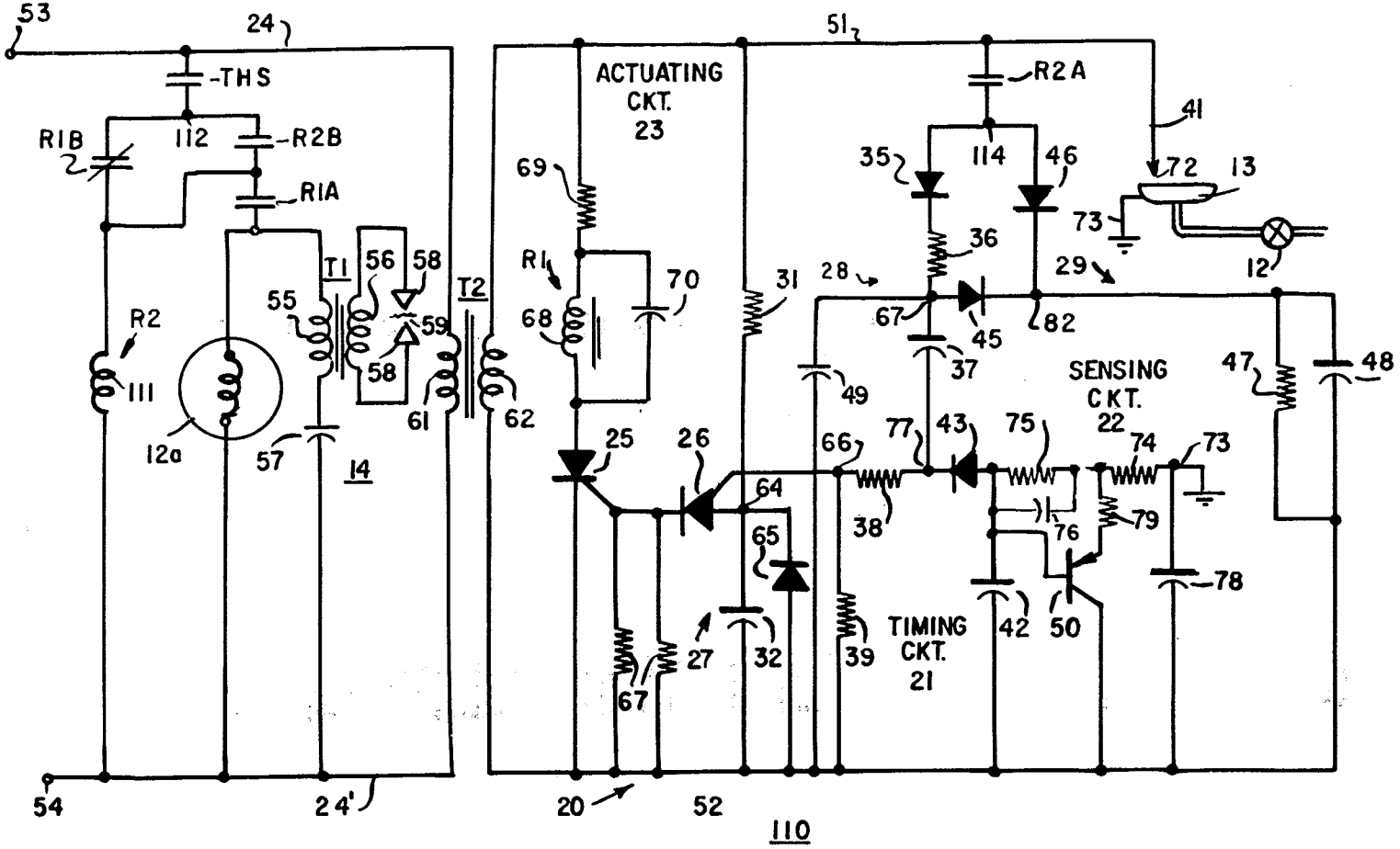
FIG. 3 is a schematic circuit diagram of a fuel ignition control system which is similar to the system shown in FIG. 1, and which further includes an interlock arrangement for preventing operation of fuel supply valves under certain fault conditions.

Referring to FIG. 3, there is shown a schematic circuit diagram of a third embodiment for a fuel ignition control system 110 provided by the present invention. The system 110 employs the fuel supply valve 12, the igniter 14, and the control circuit 20 of the system 10 shown in FIG. 1, and accordingly elements of the system 110 have been given the same reference numerals as corresponding elements of the system 10.

In addition, the system 110 includes a checking or interlock relay R2 which, together with relay R1, provides an interlock arrangement, similar to that disclosed in my U.S. patent application, Ser. No. 761,660, filed Jan. 24, 1977. The interlock arrangement prevents operation of the fuel valve 12 and maintains the control circuit 20 disabled, if for any reason contacts R1A of relay R1, which control the operation of the fuel valve 12, are closed at the time of occurrence of a request for heat.

More specifically, the fuel valve 12 and the igniter 14 are energized over an energizing path provided by contacts R1A of relay R1 and contacts R2B of relay R2, which are closed whenever the relays are operated. The checking relay R2 is normally deenergized, and is energized over normally closed contacts R1B of the relay R1 in response to a request for heat, and can be energized only if relay R1 is deenergized and its contacts R1B are closed. If relay R2 fails to operate following a request for heat, then the energizing path for the fuel valve 12 is interrupted, preventing operation of the valve.

In the system 110, power is continuously applied to input terminals 53 and 54, and the checking relay R2 is energized in response to the closing of thermostatically controlled contacts THS which close in response to a request for heat. The control circuit 20 is energized continuously and independently of contacts THS, and in the absence of a request for heat, relay R2 disables the control circuit by disconnecting power from the gate control network 28 and its associated fast discharge network 29, to maintain relay R1 deenergized. Thus, under normal operating conditions, relay R1 is deenergized in the absence of a request for heat and its contacts R1B are normally closed. However, should a fault condition develop in the control circuit 20 which permits relay R1 to operate in the absence of a request for heat, then contacts R1B will be open, preventing the checking relay R2 from operating the next time contacts THS close.

Considering the system 110 in more detail, input terminals 53 and 54 are connected to a source of 24 VAC, supplying AC power to conductors 24 and 24'. Relay R2 has an operate winding 111 connected in series with normally closed contacts R1B and normally open contacts THS between conductors 24 and 24' to permit energization of the winding 111 whenever contacts THS close and contacts R1B are closed. Contact R2B of the relay R2 are connected in shunt with contacts R1B or relay R1 to provide a holding path for the relay R2 when relay R1 operates to open contacts R1B. Contacts R1A or relay R1 connect the fuel valve 12 and the igniter 14 to the holding path provided by contacts R2B whenever the relay R1 operates. Contacts R1A and R1B or relay R1 employ a common armature of the relay R1 so that if contacts R1A become welded together, contacts R1B cannot reclose when relay R1 is deenergized at the end of a heating cycle. Under such condition, contacts R1B interrupt the energizing path for relay R2 so that the relay R2 is prevented from operating when contacts THS close on the next call for heat.

The control circuit 20 is activated over transformer T2, continuously and independently of the thermostatically controlled contacts THS. Relay R2 disables the control circuit 20 in the absence of a request for heat to maintain relay R1 deenergized. To this end, relay R2 has normally open contacts R2A which disconnect power from the gate control network 28 and the discharge network 29. Whenever relay R2 is deenergized, contacts R2A, which are connected between conductor 51 and the anodes of diodes 35 and 46 at point 114, interrupt the charging paths for capacitor 37 of the gate control network 28 and capacitor 48 of the discharge network 29. Thus, relay R2 maintains the control circuit 20 disabled by preventing capacitor 37 from charging in the absence of a request for heat. This also assures that the full trial for ignition time will be provided. Although capacitor 32 is charged and discharged, enabling the PUT device 26, during each cycle of the AC signal, the charge on capacitor 32 is limited to a value that is insufficient to enable the SCR device 25 so that relay R1 is maintained deenergized.

Operation

Considering the operation of the system 110, the control circuit 20 is energized over transformer T2 whenever power is applied to input terminals 53 and 54, permitting capacitor 32 to be charged and discharged during each cycle of the AC signal, enabling the PUT device 26. In the absence of a request for heat, contacts THS are open so that relay R2 is deenergized and its contacts R2A disconnect power from the PUT gate control network 28 and the discharge network 29, maintaining capacitor 37 discharged. Thus, with the gate control network 28 disabled, capacitor 32 enables the PUT device 26 early in each cycle of the AC signal and before the discharge current of capacitor 32 is sufficient to enable the SCR device 25 so that relay R1 is maintained disabled.

When contacts THS close in response to a request for heat, the operate winding 111 of relay R2 is energized over the path provided by contacts THS and R1B. Relay R2 then operates closing contacts R2A to connect power to the gate control network 29 and the discharge network 29. Contacts R2B also close to provide a shunt path around contacts R1A.

With the gate control network 28 enabled, the control circuit 20 operates in the manner described above with the PUT device 26 being enabled later in each cycle of the AC signal and when the discharge current of capacitor 32 is sufficient to effect operation of the relay R1 during the trial for ignition interval defined by the charging time of capacitor 37. Also, capacitor 48 of the discharge network 29 is charged over diode 46 to provide a reverse bias for the diode 45, decoupling capacitor 37 from the fast discharge path over resistor 47.

When relay R1 operates, contacts R1B open, interrupting the energizing path for relay R2 which is then maintained energized over its contacts R2B. Contacts R1A close connecting the operate solenoid 12A of the valve to the holding path for energization, permitting the valve to operate to supply fuel to the burner 13. The igniter 14 is also connected to the holding path over contacts R1A and operates to generate sparks for igniting the fuel supplied to the burner 13.

When a flame is established, flame current provided by the sensing circuit 22 establishes a control potential at the gate of the PUT device 26 in the manner described above, to maintain the PUT device 26 conducting and to keep the relay R1 operated after the end of the trial for ignition interval.

When the heating demand has been met, contacts THS open, deenergizing the valve 12 and the igniter 14. Also, relay R2 is deenergized, opening contacts R2A and R2B. When contacts R2A open, power is disconnected from the gate control network 28 and the discharge network 29, permitting capacitor 48 of the discharge network to discharge over resistor 47. This removes the reverse bias from diode 45 and permits capacitor 37 to discharge. Also, since loss of flame current removes the control potential from the gate of the PUT device 26, capacitor 32 does not charge sufficiently to enable the SCR device 25 so that relay R1 is deenergized, opening contacts R1A and closing contacts R1B. The system 110 is then prepared for the next heating cycle.

As indicated above, the control circuit 20 is continuously energized. Accordingly, should a fault condition develop which permits relay R1 to be operated while contacts THS are open, then when contacts THS close on the next call for heat, contacts R1B or relay are open, preventing energization of relay R2 and fuel valve 12. If contacts R1A, become welded together, then, when relay R1 is deenergized at the end of a heating cycle, contacts R1B, cannot reclose. Under such condition, the system 110 is locked out when contacts THS close at the start of the next heating cycle.

Fourth Embodiment

Figure 4:
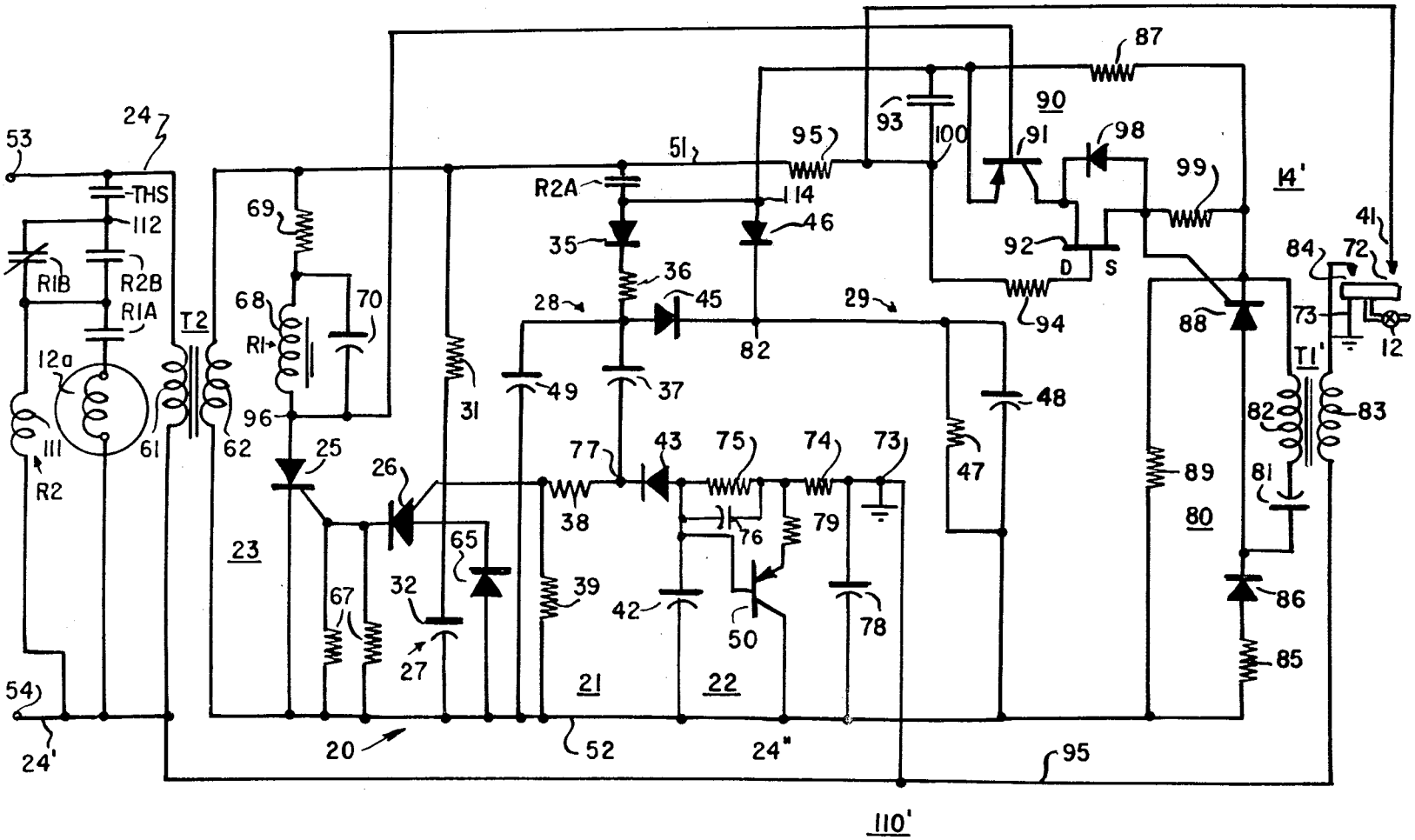
FIG. 4 is a schematic circuit diagram of a fuel ignition control system which is similar to the system shown in FIG. 2, and which includes the interlock arrangement of the system shown in FIG. 3.

Referring to FIG. 4, there is shown a schematic circuit diagram of a fourth embodiment for a fuel ignition concuit diagram of a fourth embodiment for a fuel ignition control system 110' provided by the present invention. The system 110' includes the fuel supply valve 12, the control circuit 20 and the spark generator 14' of the system 10' shown in FIG. 2. The system 110' also includes the checking relay R2 which is employed in the system 110 shown in FIG. 3. Accordingly, elements of the system 110' shown in FIG. 4 have been given the same reference numerals as corresponding elements of the systems shown in FIGS. 2 and 3.

The checking relay R2 prevents energization of the fuel valve 12 under fault conditions of the control circuit 20 or for welded contacts failure of the relay R1 as described above with reference to FIG. 3. Relay R2 is energized over normally closed contacts R1A of relay R1, and operates to provide a holding path via its contacts R2B.

The checking relay R2 also controls the enabling of the gate control network 28 and the fast discharge network 29 of the control circuit 20 by extending power to point 114 via its contacts R2A as described above. In addition, the checking relay R2 controls the enabling of the spark generator 14' to permit operation of the spark generator 14' only when relay R2 is operated. To this end, normally open contacts R2A of relay R2 are connected in the charging path for capacitor 81 of the spark generating circuit 80 so that the charging path is interrupted at point 114 whenever the relay R2 is deenergized. As shown in FIG. 4, the charging path for capacitor 81 extends from conductor 52 over resistor 85, diode 86, the capacitor 81, winding 82 and resistor 87 to point 114, which is connected to conductor 51 over contacts R2A whenever the contacts are closed. The emitter of transistor 91 of the enabling circuit 90 is also connected to point 114 to permit enabling of the transistor 91 only when relay R2 is operated.

Operation

The operation of the system 110' is similar to that of system 110, and accordingly will not be described in detail. Briefly, in the absence of a request for heat, contacts THS are open so that relay R2 is deenergized. Although the control circuit 20 is continuously activated, the gate control network 28 is disabled when relay R2 is deenergized, and thus relay R1 is maintained deenergized. Also, the spark generator 14' is disabled so that spark generation is inhibited.

When contacts THS close, in response to a request for heat, relay R2 is energized over normally closed contacts R1B of relay R1 and operates to close its contacts R2A connecting power to point 114, and to close its contacts R2B providing a holding path for the relay R2. When contacts R2A close, capacitor 37 charges, establishing a control potential at the gate of the PUT device 26 which allows capacitor 32 to charge to a value sufficient to permit enabling of the relay R1. Also, the charging path for capacitor 81 of the spark generator 80 is completed to conductor 51, and the emitter of transistor 91 is connected to conductor 51. Accordingly, capacitor 81 charges during negative half cycles of the AC signal. Also, the transistor 91 conducts, supplying current through the FET device 92 for controlling the enabling of the SCR device 88 as described above with reference to FIG. 2. The SCR device 88 conducts during positive half cycles, discharging the capacitor 81 over the ignition transformer T1' producing sparks for igniting fuel supplied to the burner 13.

When relay R1 operates, contacts R1B open and contacts R1A close, connecting the fuel valve solenoid 12A to the holding path for energization, permitting the valve to operate to supply fuel to the main burner 13.

As described above with reference to FIG. 2, when a flame is established, the flame sensing circuit 22 establishes a control potential at the gate of the PUT device 26 to cause capacitor 32 to charge to a value sufficient to enable the SCR device 25 to maintain relay R1 operated. Also, the voltage drop across resistor 95, which is applied to the gate of the FET device 92, stops the flow of gate current to the SCR device 88, preventing further discharging of capacitor 81 thereby terminating spark generation. The spark generating circuit 80 is maintained disabled as long as flame current is provided. In the event of a flameout condiction, the loss of flame current permits reenabling of the FET device 92 as described above.

When the heating demand has been met, contacts THS open, deenergizing the fuel valve 12 to interrupt the supply of fuel to the burner 13 to extinguish the flame. Also, relay R2 is deenergized, opening contacts R2B to interrupt the holding path, and opening contacts R2A. This disables the control circuit 20 causing deenergization of relay R1, and disables the spark generator 14' by interrupting the charging path for capacitor 81 and inhibiting transistor 91 of the enabling circuit 90.

For a fault condition of the control circuit 20 which permits relay R1 to operate in the absence of a request for heat, or for a welded contact failure of relay R1, contacts R1B are maintained open, preventing operation of the checking relay R2. Under such condition, the system 110' is locked out and the fuel valve 12 is maintained deenergized.

In an exemplary embodiment, the resistance and capacitance components of the timing circuit 21 and the flame sensing circuit 22 had the values listed below in Table I.

TABLE I

| | |
|---|---|
| Resistor 31 = 390 K ohms | Capacitor 32 = .33 microfarads |
| Resistor 36 = 2.2 Megohms | Capacitor 37 = 1 microfarad |
| Resistor 38 = 2.2 Megohms | Capacitor 42 = 1 microfarad |
| Resistor 39 = 390 K ohms | Capacitor 48 = .47 microfarads |
| Resistor 47 = 220 K ohms | Capacitor 49 = .01 microfarads |
| Resistor 47' = 10 Megohms | Capacitor 76 = .018 microfarads |
| Resistor 74 = 470 K ohms | Capacitor 78 = .1 microfarads |
| Resistor 75 = 68 K ohms | |
| Resistor 79 = 470 K ohms | |

The component values listed in Table I are representative for one embodiment and not intended as a limitation on the scope of the present invention.

Fifth Embodiment

Figure 5:
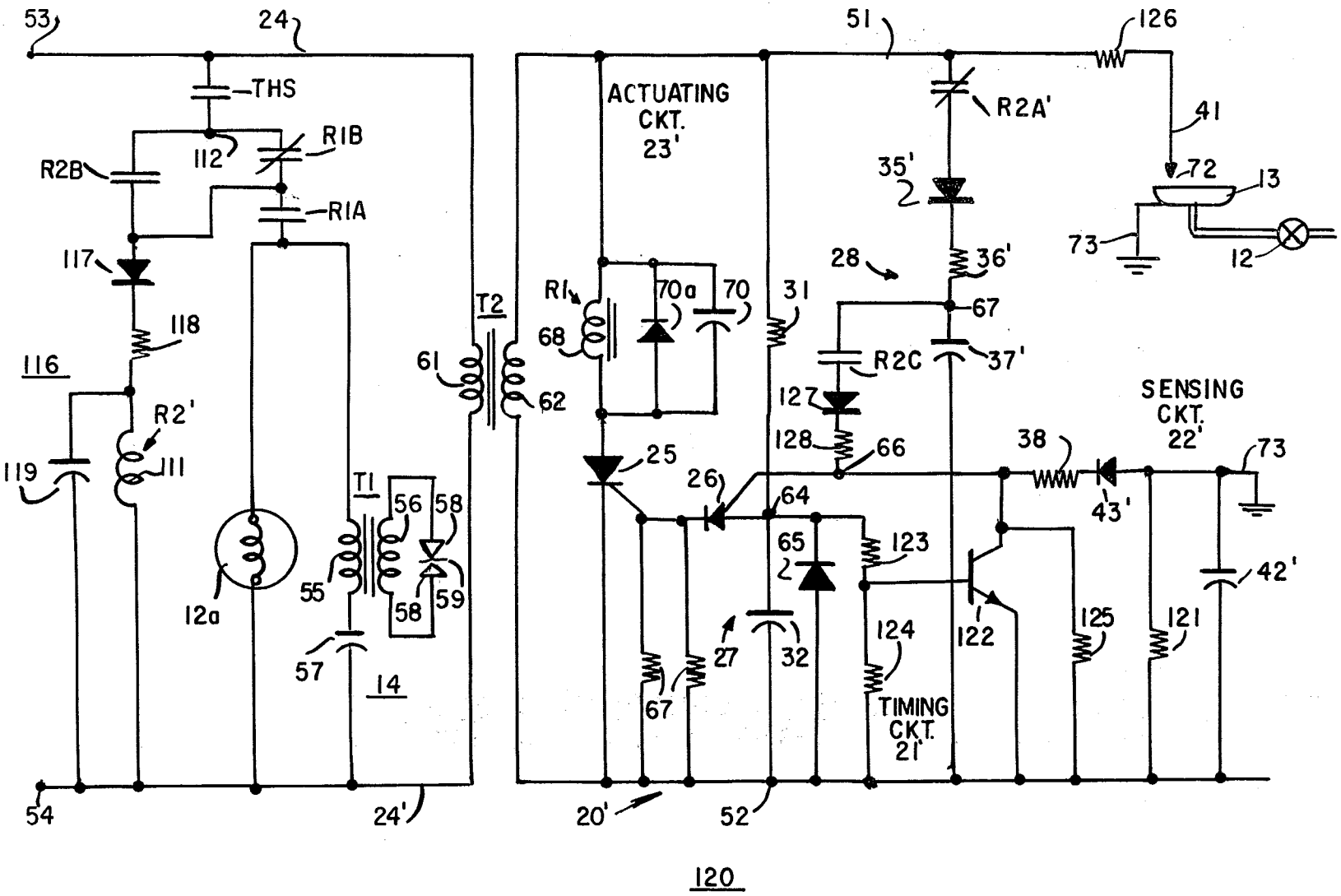
FIG. 5 is a schematic circuit diagram of a fuel ignition control system similar to the system shown in FIG. 3, but which employs capacitive discharge timing to define the trial for ignition interval.

Referring to FIG. 5, there is shown a schematic circuit diagram of a fifth embodiment for a fuel ignition control system 120 provided by the present invention. The system is similar to the one shown in FIG. 3 in that a checking relay R2', energized over contacts R1B of the flame relay R1, provides an integrity check on the operability ability of a control circuit 20' and the flame relay R1. Also, contacts R2A' of the checking relay control a timing network 28' which defines the trial for ignition interval. Accordingly, like elements of the system 120 have been given the same reference numerals as corresponding elements of the system 110, and similar elements have the same reference numerals with a prime notation.

Timing circuit 21' employs capacitive discharge timing to define the trial for ignition interval. Timing capacitor 37' is connected in series with normally closed contacts R2A' of relay R2', diode 35' and resistor 36' between conductors 51 and 52, permitting the capacitor 37' to be charged whenever power is applied to conductors 51 and 52.

When relay R2' is operated at the start of a heating cycle, contacts R2A' open, disconnecting capacitor 37' from the source of charging current, and contacts R2C' close, completing a discharge path for the capacitor 37'. The discharge path extends from one side of capacitor 37' at 67, over contacts R2C', diode 127 and resistor 128 to the gate of the PUT device 26, and thence over the gate to cathode circuit of the PUT device 26 and resistors 67 to conductor 52 which is connected to the other side of capacitor 37'. The potential provided at the gate of the PUT device as capacitor 37' discharges, causes the PUT device to be enabled near the midpoint of each positive half cycle of the AC signal and at a time when capacitor 32 has charged to a value sufficient to trigger the SCR device 25 and thus energize relay R1. If a flame is not sensed before the end of the trial for ignition interval, that is when capacitor 37' discharged, then the PUT device 26 is enabled earlier in the positive cycles and before capacitor 32 has charged to a value sufficient to enable the SCR 25, so that the relay R1 becomes deenergized. If a flame is established, a flame sensing circuit 22' provides a control potential at the gate of the PUT device 26 to maintain relay R1 operated.

The flame sensing circuit 22' includes resistor 126, sensor probe 72, resistor 121 and capacitor 42'. When a flame bridges the gap between the sensor electrode 72 and the grounded burner 13, current flows from conductor 51 over resistor 126 and the flame to ground reference point 73, and thence over capacitor 42' to conductor 52', charging capacitor 42'. Resistor 121 provides a discharge path for capacitor 42, for flame out conditions. Current also flows from point 73 over isolation diode 43' and resistor 38 to the gate of the PUT device, providing the control potential which enables relay R1 to remain operated. Diode 43' is reversed biased in the absence of a flame signal and isolates or decouples the flame sensing circuit 22' from the timing network 28 in the absence of a flame at the burner 13. Also, the control potential provided by the flame sensing circuit 22' reverse biases diode 127 to decouple the timing network 28 from the gate of the PUT device, and thus from the flame sensing circuit.

A clamping circuit comprised of transistor 122, voltage divider resistors 123 and 124 and resistor 125 limits the potential at the gate of the PUT device 26 when flame current is provided.

A delay network 116 comprised of resistor 118 and capacitor 119 provides a few millisecond delay in the operation of relay R2' when contacts THS close. In the case of a line voltage interruption, when power is restored, the delay on the pull in of relay R2' allows timing capacitor 37' to be fully charged before relay R2' operates.

Operation

When power is applied to input terminals 53 and 54, conductors 51 and 52 are energized, so that the control circuit 20' is energized. Assuming that contacts THS are open, then relay R2' is deenergized and contacts R2A' are closed and contacts R2C' are open. Accordingly, during positive half cycles, current flows from conductor 51 over contacts R2A', diode 35' and 36' and capacitor 37' to conductor 52, charging the capacitor 37'. Current also flows from conductor 51 through resistor 31 and capacitor 32 charging the capacitor. In the absence of a control potential at the gate of the PUT device 26, the PUT device conducts and discharges capacitor 32 before it stores sufficient charge to enable the SCR device 25. During negative half cycles, diode 65 bypasses current around capacitor 32.

In response to a request for heat, contacts THS close, and the time delay network 116 is energized. After the delay established by the charging time of capacitor 119, relay R2' operates opening contacts R2A' and closing contacts R2C' to connect timing capacitor 37' to the gate of the PUT device. Contacts R2B' close to provide a holding path for the relay. When contacts R2C' close, capacitor 37' discharges increasing the potential at the gate of the PUT device Accordingly, capacitor 32 must charge for a longer portion of each positive half cycle of the AC signal before the PUT anode potential exceeds the gate potential by 0.6 volts. For such condition, the charge stored by capacitor 32 at the time the PUT device 26 enabled, is sufficient to enable the SCR device 25, and operate relay R1.

The PUT device provides a trigger pulse to the SCR device during each cycle, the SCR device being cutoff with the position to negative transition of the AC signal. Relay R1, once operated, is maintained operated during negative half cycles by capacitor 70 and free wheeling diode **70*a***.

Relay R1, when operated closes its contacts R1A to energize the main valve solenoid 12A and the spark generating circuit 14. When the fuel supplied to the main burner 13 is ignited, the flame bridges the gap between the sensor electrode 72 and the grounded burner 13 enabling current to flow from conductor 51 over resistor 26, the flame to ground reference point 73 and over diode 43' and resistor 38 to the gate of the PUT device 26. Current also flows through capacitor 42', charging the capacitor.

If a flame fails to be provided before the end of the trial for ignition interval, that is before capacitor 37' becomes discharged, the voltage on the gate of the PUT device 26 decreases and the PUT device is enabled before capacitor 32 stores sufficient energy to trigger the SCR device 25. This permits relay R1 to drop out opening contacts R1A to deenergize the main valve solenoid 12A and the spark generator 14.

For a flameout following a successful ignition cycle, the charge stored on capacitor 42' provides a control potential at the gate of the PUT device 26 for maintaining relay R1 operated for a time interval comparable to the trial for ignition period. This provides sufficient time for the spark generator to reignite the main burner and prevents the system from being locked out.

As indicated above, relay R2' is energized over a path provided by normally closed contacts R1B of the flame relay. If an unsafe fault occurs in the timing circuit 21', which permits relay R1 to be operated in the absence of a flame, then when contacts THS close, contacts R1B are open, and relay R2', the main valve solenoid 12A and the spark generator 14 main deenergize in the locked out condition. With this arrangement, the integrity of the control circuit 21 and relay R1 are checked each and every time the thermostat calls for heat.

For a momentary interruption of power following a successful ignition cycle, relays R1 and R2' and the main valve will be deenergized. Upon restoration of power, the reoperation of relay R2' is delayed by the delay circuit 116 for a time sufficient to permit capacitor 37' to be fully charged. When relay R2' operates, the ignition cycle is initiated as described above. If the interruption should be of sufficiently short duration that the flame is still established at the burner when power is restored, then the timing circuit 21' will enable relay R1 to operate opening contacts R1B thereby disconnecting power from the operate winding 111 of the checking relay R2'. Also, the main valve solenoid 12A will be deenergized and eventually the flame will become extinguished. At such time, the timing circuit 21' will disable the relay R1 permitting a new trial for ignition to be initiated.

Having thus disclosed in detail a preferred embodiment of my invention, persons skilled in the art will be able to modify certain of the structure which has been disclosed and to substitute equivalent elements for those which have been illustrated; and it is, therefore, intended that all such modifications and substitutions be covered as they are embraced within the spirit and scope of the appended claims.

I claim:

1. In a fuel ignition system including a fuel supply valve having an operate solenoid, said fuel supply valve being operable to supply fuel to a burner apparatus, and spark generating means for providing sparks for igniting fuel emanating from the burner apparatus, a control arrangement comprising: input means connectable to a source of power for energizing said control arrangement; actuating means operable when enabled to connect said operate solenoid to said input means for energization to operate said fuel supply valve; control means including first switching means for controlling the operation of said actuating means, and ignitiion timing means including a timing network having a capacitor, second switching means normally connecting said timing means to a source of power to permit said capacitor to be charged, said second switching means being operable to cause said capacitor to discharge to generate a timing signal during a trial for ignition interval defined by the discharge time of said capacitor, first signal coupling means responsive to said timing signal for coupling said timing means to a control input of said first switching means to permit said timing signal to be extended to said control input thereby enabling said first switching means to cause said actuating means to be enabled during said trial for ignition interval, and to cause said actuating means to be disabled at the end of said trial for ignition interval; and flame sensing means for generating a control signal when a flame is provided at said burner apparatus; said control means further including second signal coupling means for coupling for said flame sensing means to said control input of said first switching means to permit said control signal to be extended to said control input for enabling said first switching means to continue to cause said actuating means to be enabled after said trial for ignition interval, and said second signal coupling means decoupling said flame sensing means from said control input of said first switching means and said timing means in the absence of said control signal, and said first signal coupling means being responsive to said control signal to decouple said timing means from said control input of said first switching means and said flame sensing means.

2. A system as set forth in claim 1 wherein said timing means includes a timing network having circuit means providing a charging path for said capacitor to permit said capacitor to be normally maintained charged, and discharge means, including said first signal coupling means, providing a discharge path for said capacitor to permit said capacitor to discharge over said first signal coupling means when said second switching means operates, to provide said timing signal during said trial for ignition interval.

3. A system as set forth in claim 2 wherein said second switching means is operable to interrupt said charging path and to connect said timing network to said first signal coupling means to provide said discharge path.

4. A system as set forth in claim 3 wherein said input means includes activate means responsive to a predetermined condition to enable said second switching means over a first circuit path which is completed by said actuating means whenever said actuating means is disabled, said second switching means being operable when enabled to complete a second circuit path, and said actuating means being operable when enabled to interrupt said first circuit path and to connect said operate solenoid to said second circuit path for energization.

5. A system as set forth in claim 4 wherein said control means is connected to a source of power to be energized continuously and independently of said activate means, and wherein said second switching means normally disconnects power from said timing means and is operable when enabled to connect power to said timing means.

6. In a fuel ignition system including a fuel supply means operable when energized to supply fuel to a burner apparatus, and spark generating means for providing sparks for igniting fuel emanating from the burner apparatus, a control arrangement comprising: actuating means operable when enabled to energize said fuel supply means, control means including first switching means connected to said actuating means, and ignition timing means including a timing network having capacitance means and circuit means for providing a charging path for said capacitance means, second switching means normally connecting said capacitance means to said charging path to enable said capacitance means to be maintained charged, discharge means including first signal coupling means for providing a discharge path for said capacitance means, said second switching means being operable to interrupt said charging path and to connect said capacitance means to said discharge path to permit said capacitance means to discharge, generating a timing signal, and first signal coupling means coupling said timing network to a control input of said first switching means to enable said first switching means to respond to said timing signal and cause said actuating means to be enabled during a trial for ignition time interval defined by the discharge time of said capacitance means, and to cause said actuating means to be disabled at the end of said trial for ignition interval; flame sensing means for providing a control signal when a flame is provided at said burner apparatus; and second signal coupling means responsive to said control signal for coupling said flame sensing means to said control input of said first switching means to inhibit said first signal coupling means and thereby decouple said timing network from said control input and said flame sensing means and to enable said first switching means to continue to cause said actuating means to be enabled after said trial for ignition interval, said second coupling means being responsive to said timing signal to decouple said flame sensing means from said first switching means and said timing network in the absence of said control signal.

7. A system as set forth in claim 6 which further comprises activate means for generating a request signal for enabling said second switching means, said control means being connected to a source of power to be energized continuously and independently of said activate means, permitting said means to be maintained charged in the absence of said request signal.

8. A system as set forth in claim 7 which includes means for delaying the operation of said second switching means for a preset interval of time after said request signal is generated.

* * * * *